United States Patent [19]

Connolly et al.

[11] 4,022,673

[45] May 10, 1977

[54] ELECTROCHEMICAL PRODUCTION OF 1,4-DIHYDRO AROMATIC COMPOUNDS

[75] Inventors: John F. Connolly, Wheaton; Robert J. Flannery, Olympia Fields, both of Ill.

[73] Assignee: Standard Oil Company (Indiana), Chicago, Ill.

[22] Filed: Dec. 19, 1975

[21] Appl. No.: 642,407

[52] U.S. Cl. ..... 204/73 R; 204/59 R

[51] Int. Cl.[2] ..... C25B 3/04

[58] Field of Search ..... 204/59 R, 72, 73 R

[56] References Cited

UNITED STATES PATENTS 3,699,020 10/1972 Connolly et al. ..... 204/73 R

*Primary Examiner*—F.C. Edmundson

*Attorney, Agent, or Firm*—William H. Magidson; Arthur G. Gilkes; William T. McClain

[57] ABSTRACT

Aromatic hydrocarbon compounds are selectively reduced electrochemically to their 1,4-dihydro derivatives in an ammoniated solvent-electrolyte system under conditions selected to effect oxidation of ammonia and improved long-term current efficiency.

21 Claims, 2 Drawing Figures

ELECTROCHEMICAL PRODUCTION OF 1,4-DIHYDRO AROMATIC COMPOUNDS

BACKGROUND OF THE INVENTION

1. Field of the Invention

This invention relates to an electrochemical method for producing a 1,4-dihydro aromatic hydrocarbon with ammonia as the anode depolarizer and with improved long-term current efficiency.

2. Discussion of the Prior Art

U.S. Pat. No. 3,699,020 discloses a process for the production of a 1,4-dihydro aromatic hydrocarbon compound comprising electrochemically reducing at a cathode an aromatic hydrocarbon compound contained in an organic solvent-electrolyte system, introducing ammonia into this system, and concurrently oxidizing ammonia at an anode.

Experimentation subsequent to the filing of the application for U.S. Pat. No. 3,699,020 has indicated that, although operative, the method of U.S. Pat. No. 3,699,020 is often characterized by continuously declining current efficiencies, when a large extent of cathode reaction occurs, that is electrolyses of relatively long duration and with relatively large current densities. For example, under the conditions of Examples I and II in U.S. Pat. No. 3,699,020, the current efficiency for the production of the 1,4-dihydro product ultimately declined to zero in electrolyses of long duration, and it was necessary to disassemble the cell and clean the cathode with sandpaper in order to regenerate high current efficiency for the production of the 1,4-dihydro product. Such effects were not originally detected in Examples I and II of U.S. Pat. No. 3,699,020 because the electrolyses therein were of short duration.

SUMMARY

Figure 2:
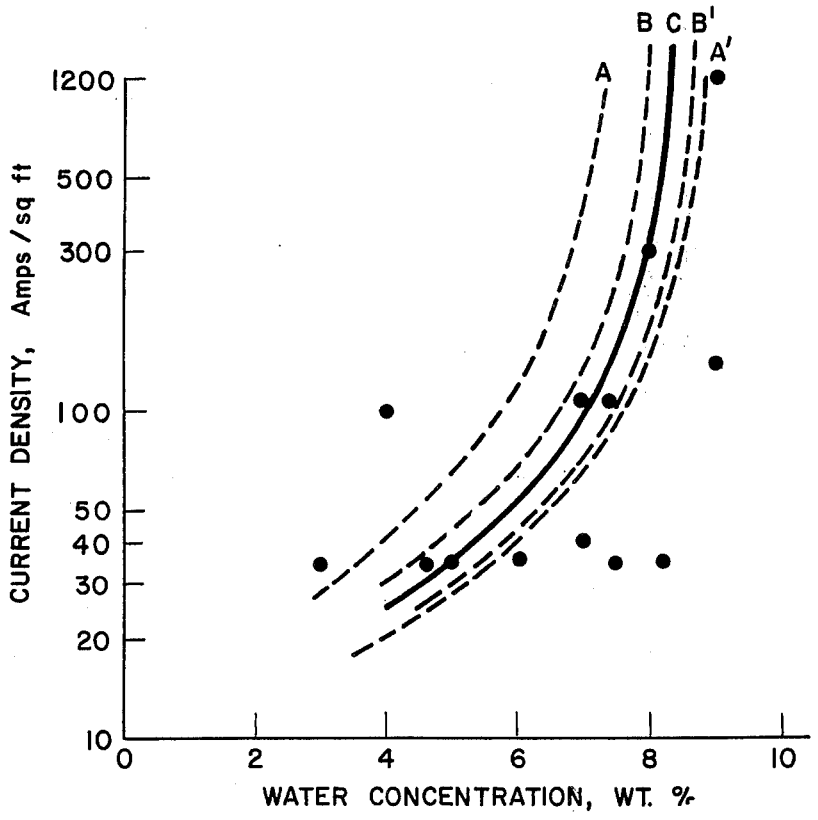
FIG. 2 is a plot of current densities versus concentrations of water in the solvent-electrolyte system of this invention showing the claimed ranges of water concentration for particular current densities.

This invention involves a method for improving the long-term current efficiency in the electrochemical production of 1,4-dihydro aromatic hydrocarbon compounds by minimizing the problems of poisoning and erosion of the cathode and decomposition of the electrolyte. The electrochemical process involves electrochemically reducing at a cathode in an electrochemical cell and a condensed-ring aromatic hydrocarbon compound dissolved in an organic solvent-electrolyte system containing water, introducing ammonia into the solvent-electrolyte system, and concurrently oxidizing ammonia and evolving nitrogen at an anode. The improvement is effected by reducing an aromatic hydrocarbon compound at a current density in the range of from about 20 to about 1200 amperes per square foot and in the presence of water at a concentration level in the solvent-electrolyte system in a range which varies depending upon the particular current density, as indicated in FIG. 2 as the region between curves A and A′, preferably as the region between curves B and B′ and more preferably on curve C, for a particular current density. The cell voltage employed is that necessary to provide the desired current density.

DETAILED DESCRIPTION OF THE INVENTIOn

This invention is an improvement in a process for the production of a 1,4-dihydro aromatic hydrocarbon compound comprising electrochemically reducing at a cathode in an electrochemical cell a condensed-ring aromatic hydrocarbon compound having at least two aromatic rings and dissolved in an organic solvent-electrolyte system containing water, introducing ammonia into this system and concurrently oxidizing ammonia and evolving nitrogen at an anode in the electrochemical cell.

The improvement comprises oxidizing the aromatic hydricarbon at a current density in the range of from about 20 to about 1200 amperes per square foot and in the presence of water at a concentration level in the solvent-electrolyte system in the range shown between the curves A and A′ for a particular current density in FIG. 2 and impressing a voltage between the anode and cathode in the electrochemical cell which is sufficient to provide the desired current density.

Preferably the condensed-ring aromatic hydrocarbon compound is selected from the group consisting of naphthalene, alkyl-substituted naphthalenes, and benzo-substituted naphthalenes. More preferably, the condensed-ring aromatic hydrocarbon compound is naphthalene, and the product is 1,4-dihydronaphthalene. Preferably, the condensed-ring aromatic hydrocarbon compound is present at a level in the range of from about 10 to about 30 weight percent in the solvent-electrolyte system.

Preferably, the solvent-electrolyte system comprises a major amount of an aprotic organic liquid together with about 2 to 25 weight percent of a tetra-alkyl-substituted ammonium halide, wherein the alkyl substituents contain at least three carbon atoms and the halide is bromide or chloride. The aprotic organic liquid is at least one material selected from the group preferably consisting of dialkylene glycol dialkyl ether, diglyme, triglyme, dioxane, acetonitrile, tetrahydrofuran, dimethyl formamide and dimethyl sulfoxide and more preferably consisting of diethylene glycol dimethyl ether, digylme, acetonitrile, and tetrahydrofuran. Preferably, the tetra-alkyl ammonium halide is tetrabutyl ammonium bromide.

The concentration of ammonia in the solvent-electrolyte system is preferably in excess of that required for the anodic reaction and more prefeably is about 1 weight percent. The cathode preferably is a metal selected from the group consisting of mercury, lead, tin, aluminum, cadmium and zinc and more preferably is lead. The anode is preferably selected from the group consisting of graphite, carbon, platinum, platinized graphite, and platinized carbon.

The current density is preferably in the range of from about 50 to about 600 amperes per square foot, and more preferably in the range of from about 100 to about 400 amperes per square foot. Water is at a concentration level in the solvent-electrolyte system preferably in the range shown between curves B and B′, and more preferably along curve C, for a particular current density in FIG. 2. The solvent-electrolyte system is maintained at a temperature preferably in the range of from about 50° F. to about 150° F. and more preferably in the range of from about 70° F. to about 120° F.

The improvement in the long-term current efficiency for the production of 1,4-dihydro products and the minimization of the problems of poisoning and erosion of the cathode and of decomposition of the electrolyte were achieved by the discovery of the surprising relationship between the current density and the concentration of water in the solvent-electrolyte system. Since, according to the disclosure of U.S. Pat. No. 3,669,020, the entirety of which is specifically incorporated herein by reference, the water required for the cathodic reaction is regenerated in the electrochemical reactions of this method and since the electrolysis of water is an undesirable side reaction in this method, conventional electrochemical wisdom would suggest the undesirability of increasing the water content, particularly at high current density where side reactions usually become more significant. Nevertheless, in contradiction to such expectations, it was found that the use of increased current densities in the electrochemical production of 1,4-dihydro aromatic hydrocarbon compounds required higher water concentrations in the solvent-electrolyte system if the aforementioned long-term decomposition of the electrolyte and erosion (or development of pits) of the cathode, in combination with the formations of an amalgam-like sludge on the cathode, were to be avoided. However, the use of excessive amounts of water required that the current density be increased if the aforementioned long-term decline of the current efficiency and poisoning of the electrode were to be avoided.

When the concentration of water in the solvent-electrolyte system is lower than the claimed range of water concentrations for a particular current density in the method of this invention, the electrolyte decomposes, the lead cathode develops pits, and an amalgam-like sludge forms. Though the scope of this invention is not to be limited thereby, it is postulated that the decomposition of tetraalkyl ammonium ions proceeds as follows:

$$R_4N^+ + e^- \rightarrow R_4N\cdot \rightarrow R_3N + \text{olefin} + \tfrac{1}{2} H_2$$

where R is an alkyl radical containing at least three carbon atoms. Lower water concentrations could increase the reducibility of $R_4N^+$ because of lower stability of the tetraalkyl ammonium ion due to less hydration. Further, the tetraalkyl ammonium radical may form amalgams with the lead cathode as it is known to do with mercury cathodes.

On the other hand, when the concentration of water is the solvent-electrolyte system is higher than the claimed range of water concentrations for a particular current density in the method of this invention, the cathode is poisoned, and the current efficiency is poor. In this region, no loss of electrolyte was observed. Thus, the above-described decomposition of the tetraalkyl ammonium halide electrolyte does not occur at all. Though the scope of this invention is not to be limited thereby, it is postulated that some reduction of the tetraalkyl ammonium ion may be necessary to clean the cathode, and such reduction should be easier when less water is available for hydration of the tetraalkyl ammonium ion.

The method of this invention provides substantially improved long-term stability and current efficiency for the production of the 1,4-dihydro aromatic hydrocarbon product by employing a range of water concentrations in the solvent-electrolyte system for a particular current density where the problems of poisoning and erosion of the cathode and decomposition of the electrolyte are minimized.

EXAMPLES 1–12

Figure 1:
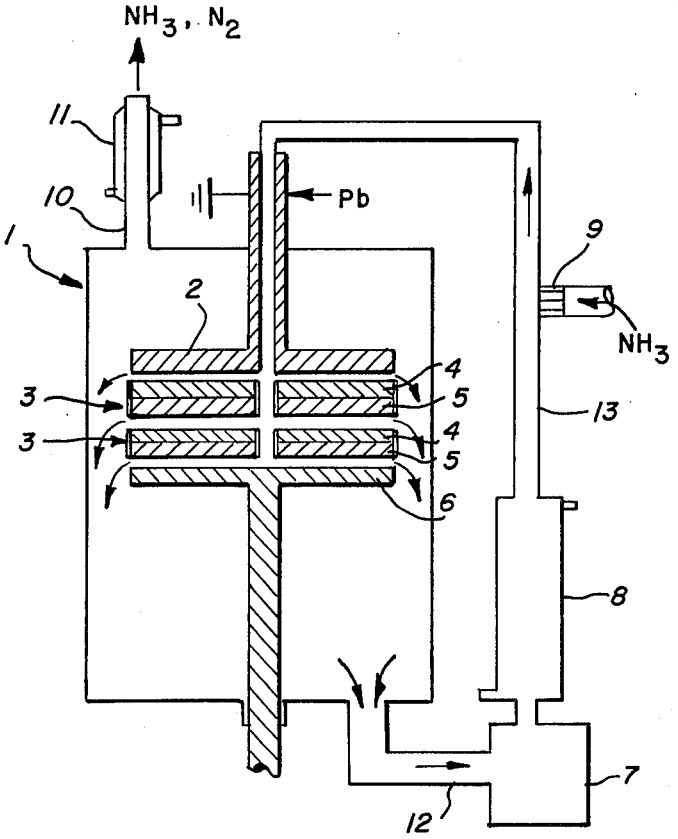
FIG. 1 is a schematic of the apparatus used to perform the method of this invention.

While any suitable apparatus can be used to practice this invention in a batch-wise or continuous fashion, the apparatus shown in FIG. 1 was used to perform batch electrochemical reductions of naphthalene to 1,4-dihydro naphthalene, in accordance with the method of this invention. The electrolysis apparatus 1 comprised three electrochemical cells which were in electrical series and were formed from ring and circular plate electrodes, with the spacing between adjacent electrodes set by plastic screws (not shown). The electrolysis solution was circulated by means of pump 7, through electrolysis apparatus 1 and through tubes 12 and 13 and introduced into electrolysis apparatus 1 at the center of uppermost, ring-shaped, lead cathode 2 and flowed downward into each electrolysis cell and then outward in parallel from the center of the electrodes in each of the three cells. A power supply (not shown) was used to apply the voltage between uppermost, lead cathode 2 and lowermost, circular plate-shaped graphite anode 6. Each of the two center pieces 3 were ring-shaped bi-electrodes, each consisting of ring-shaped, graphite anode 4 on the top and ring-shaped, lead cathode 5 on the bottom fastened together. No solution flowed between the ring-shaped, graphite anode 4 and the ring-shaped, lead cathode 5 of adjacent cells.

This compact electrode arrangement was made possible by the use of ammonia as an anode depolarizer which eliminated the need for anolyte-catholyte separators. Ammonia is more readily oxidized at the anode than are naphthalene, its reduction products, the solvent and electrolyte. On the other hand, ammonia and its oxidation products are less readily reduced at the cathode than naphthalene. Ammonia was introduced continuously into the circulating electrolysis solution through glass frit 9 in order to maintain an ammonia concentration of about 1 weight percent. Excess ammonia and nitrogen gas product escaped through outlet tube 10, which was equipped with a water jacket 11 to condense and collect entrained electrolysis solution for return to the electrolysis apparatus. A water jacket 8 for cooling the electrolysis solution, if necessary, was provided.

Very small separations of 0.02 inch to 0.03 inch between the cathode and anode of a particular cell were used, and this electrode arrangement was achievable through the use of a relatively high resistance electrolyte (about 100 ohm-centimeters) which minimized the flow of current between the anode of one cell and the anode of a different cell and between the cathode of one cell and the cathode of a different cell. Without such relatively high resistance paths between the anodes of the different cells and between the cathodes of the different cells, stray currents would result from the proximity of the anodes of the different cells and the proximity of the cathodes of the different cells, thereby causing lower current efficiency and decomposition of the graphite anodes.

The electrolysis solution was recycled through electrolysis apparatus 1 by means of tubes 12 and 13 until the desired percent of conversion of naphthalene was achieved. When the current density was about 100 amperes per square foot, the electrolysis solution was circulated fast enough to achieve an average solution speed at the electrode surfaces somewhat greater than 3 feet per second. Lower speeds were not sufficient to provide an adequate supply of naphthalene at the surface of the cathode and to remove 1,4-dihydronaphthalene from the surface of the cathode. A higher average speed of solution moving past the electrode surfaces was required when higher current densities were used. Gas chromatography was used to monitor the weight percent of conversion of naphthalene to 1,4-dihydronaphthalene.

The experimental conditions and results for Examples 1–12 are presented in Table 1. In each example, the electrolyte was tetrabutyl ammonium bromide, and the electrolysis solution was thermostatted at 100° F. and contained about 1 weight percent of ammonia. Current densities were varied by changing the current passing through the cells and the surface areas of the electrodes. The solvent was diglyme in Examples 1–10 and a blend of 50 weight percent of acetonitrile and 50 weight percent of tetrahydrofuran in Examples 11–12. In Table 1, the solution weight and starting composition, excluding ammonia, are reported in kilograms and weight percent, respectively; while the current and current density are reported in amperes and amperes per square foot, respectively; and the average voltage for each electrolysis cell is reported in volts. The current efficiency is that percent of the total current passing through the cell which results in the production of 1,4-dihydronaphthalene and is shown for various degrees of conversion of naphthalene.

The current densities are plotted against the concentrations of water in the solvent-electrolyte systems of Examples 1–12 as well as of Examples 1–2 of U.S. Pat. No. 3,699,020 in FIG. 2. The ranges of such water concentrations which provide satisfactory long-term current efficiency and stability at various current densities are indicated between curves A and A′, preferably between curves B and B′, and more preferably along curve C, in FIG. 2. Thus, the long-term current efficiency and stability actually pass through a maximum when the water concentrations used falls within the range of water concentrations between curves A and A′ for a given current density in FIG. 2, with the maximum occurring at the water concentration on curve C.

TABLE 1

| Example | Solution Composition: Total Weight | Electrolyte | Naphthalene | Solvent | Water | Current | Current Density | Cell Voltage | Current Efficiency After: X Hours | | 70% Conversion | 95% Conversion | Long-Term Performance |
|---|---|---|---|---|---|---|---|---|---|---|---|---|---|
| 1 | 8 | 5.2 | 20 | 67 | 8.2 | 15 | 34 | 3 | 57% | 19 hours | 0 | | low current |
| | | | | | | | | | 29% | 44 hours | | | efficiency |
| | | | | | | | | | 9% | 64 hours | | | |
| 2 | 8 | 10 | 20 | 62 | 7.5 | 15 | 34 | 3 | 65% | 16 hours | 32 | | low current |
| | | | | | | | | | 45% | 24 hours | | | efficiency |
| | | | | | | | | | 42% | 40 hours | | | |
| | | | | | | | | | 32% | 64 hours | | | |
| 3 | 8 | 8 | 20 | 66 | 6 | 15 | 34 | 3 | 73% | 18 hours | 44 | | low current |
| | | | | | | | | | 44% | 68 hours | | | efficiency |
| 4 | 8 | 7 | 20 | 68 | 5 | 15 | 34 | 3 | 73% | 17 hours | 70 | | satisfactory |
| | | | | | | | | | 70% | 41 hours | | | operation |
| 5 | 8 | 8 | 20 | 67 | 4.6 | 15 | 34 | 3 | 74% | 16 hours | 66 | | satisfactory |
| | | | | | | | | | 66% | 40 hours | | | operation |
| 6 | 8 | 10 | 20 | 67 | 3 | 15 | 34 | 3 | 64% | 17 hours | 65 | | cathode/pitting |
| | | | | | | | | | 65% | 41 hours | | | or high electrolyte consumption |
| 7 | 2 | 10 | 20 | 63 | 7 | 11.6 | 105 | 4 | 76% | 3 hours | 70 | 63%-20 hours | satisfactory operation |
| | | | | | | | | | 63% | 20 hours | | | |
| 8 | 2 | 10 | 20 | 63 | 7.4 | 11.6 | 105 | 4 | 64% | 20 hours | 70 | 64%-20 hours | satisfactory operation |
| 9 | 2 | 7 | 20 | 69 | 4 | 11.6 | 105 | 4 | cathode decomposes | | — | | cathode/pitting or high electrolyte consumption |
| 10 | 2 | 7 | 20 | 64 | 9 | 14.6 | 133 | 4 | 74% | 4 hours | 43 | | low current |
| | | | | | | | | | 43% | 15 hours | | | efficiency |
| 11 | .6 | 10 | 20 | 62 | .8 | 15 | 290 | 5 | 66% | 1.6 hours | 65 | 61%-5 hours | satisfactory operation |
| | | | | | | | | | 61% | 5 hours | | | |
| 12 | .7 | 10 | 20 | 61 | 9 | 25 | 1000 | 10 | 49% | 3 hours | 40 | | low current efficiency |

We claim:

1. In combination with a process for the production of a 1,4-dihydro aromatic hydrocarbon compound comprising electrochemically reducing at a cathode in an electrochemical cell, a condensed-ring aromatic hydrocarbon compound having at least two aromatic rings dissolved in an organic solvent-electrolyte system containing water, introducing and dissolving ammonia into said system and concurrently oxidizing said ammonia and evolving nitrogen at an anode in said electrochemical cell, wherein the improvement comprises reducing said aromatic hydrocarbon compound at a current density in the range of from about 100 to about 1200 amperes per square foot and in the presence of water at a concentration level in said system in the range shown between curves A and A′ for a particular current density in FIG. 2 and impressing a voltage between said anode and cathode which is sufficient to provide said current density.

2. The process of claim 1 wherein said current density is in the range of from about 100 to about 400 amperes per square foot.

3. The process of claim 2 wherein the aromatic hydrocarbon compound is a condensed-ring aromatic hydrocarbon selected from the group consisting of napthalene, alkyl-substituted naphthalenes, and benzo-substituted naphthalenes.

4. The process of claim 3 wherein the aromatic compound is naphthalene and the product is 1,4-dihydronaphthalene.

5. The process of claim 3 wherein the aromatic compound is triphenylene and the product is 1,4-dihydrotriphenylene.

6. The process of claim 20 wherein said aromatic hydrocarbon compound is present at a level in the range of from about 10 to about 30 weight percent in said system.

7. The process of claim 2 wherein the organic solvent-electrolyte system comprises a major amount of an aprotic organic liquid together with about 2 to 25 weight percent of a tetra-alkyl-substituted ammonium halide, wherein the alkyl substituents contain at least three carbon atoms and the halide is bromide or chloride.

8. The process of claim 7 wherein the aprotic organic liquid is at least one material selected from the group consisting of dialkylene glycol, dialkyl ether, diglyme, triglyme, dioxane, acetonitrile, tetrahydrofuran, dimethyl formamide and dimethyl sulfoxide.

9. The process of claim 8 wherein the aprotic organic liquid is at least one material selected from the group consisting of diglyme, acetonitrile, and tetrahydrofuran.

10. The process of claim 8 wherein the dialkylene glycol dialkyl ether is diethylene glycol dimethyl ether.

11. The process of claim 7 wherein the ammonium halide is tetrabutyl ammonium bromide.

12. The process of claim 2 wherein ammonia is maintained in solution in said solvent-electrolyte system at a concentration level in excess of that required for the anoxic oxidation.

13. The process of claim 12 wherein ammonia is maintained in solution in said solvent electrolyte system at a concentration level of about 1 weight percent.

14. The process of claim 13 wherein the cathode is lead.

15. The process of claim 2 wherein the cathode is selected from the group consisting of mercury, lead, tin, aluminum, cadmium, and zinc.

16. The process of claim 2 wherein the anode is selected from the group consisting of graphite, carbon, platinum, platinized graphite and platinized carbon.

17. The process of claim 15 wherein the anode is gaphite.

18. The process of claim 2 wherein said system is maintained at a temperature in the range of from about 50° F. to about 150° F.

19. The process of claim 18 wherein said temperature is in the range of from about 70° F. to about 120° F.

20. The process of claim 2 wherein water is at a concentration level in said system in the range shown between curves B and B′ for a particular current density in FIG. 2.

21. The process of claim 20 wherein water is at the concentration level in said system shown on curve C for a particular current density in FIG. 2.

* * * * *